US005946783A

United States Patent [19]

Plociennik et al.

[11] Patent Number: 5,946,783

[45] Date of Patent: Sep. 7, 1999

[54] HIGH-CAPACITY WIRE ROLLING MILL

[75] Inventors: Uwe Plociennik, Ratingen; Alfred Müller, Krefeld, both of Germany

[73] Assignee: SMS Schloemann-Siemag Aktiengesellschaft, Düsseldorf, Germany

[21] Appl. No.: 09/074,128

[22] Filed: May 7, 1998

[30] Foreign Application Priority Data

May 8, 1997 [DE] Germany ..... 197 19 319

[51] Int. Cl.[6] ..... B23P 17/00

[52] U.S. Cl. ..... 29/33 C; 72/228; 72/342.2

[58] Field of Search ..... 29/33 C, 527.7; 72/228, 342.2, 342.1, 226, 202

[56] References Cited

U.S. PATENT DOCUMENTS

| | | | |
|---|---|---|---|
| 1,348,230 | 8/1920 | Linard | 72/228 |
| 3,625,043 | 12/1971 | Neumann et al. | 29/33 C X |
| 3,942,350 | 3/1976 | Braver et al. | 72/228 |
| 4,918,803 | 4/1990 | Digiusto | 29/33 C |
| 5,307,663 | 5/1994 | Shore et al. | 72/235 X |
| 5,479,808 | 1/1996 | Bricmont | 29/527.7 X |
| 5,568,744 | 10/1996 | Grotepass | 72/201 |

FOREIGN PATENT DOCUMENTS

| | | | |
|---|---|---|---|
| 36851 | 9/1981 | European Pat. Off. | 72/228 |
| 3045920 | 6/1982 | Germany | 72/228 |

*Primary Examiner*—William Briggs
*Attorney, Agent, or Firm*—Friedrich Kueffner

[57] ABSTRACT

A high-capacity wire rolling mill including a wire train and/or rod steel train for concrete reinforcing steel and simple carbon steels, further including a continuous casting plant or a continuous casting wheel for high production, a direct interconnection of the continuous casting plant or casting wheel to the rolling mill, a buffer furnace between the continuous casting plant or the casting wheel and the rolling mill for compensating production differences and smaller rolling mill interruptions, a compact roughing train and intermediate train I, a unit calibration for the train sections, looping by 180° behind the intermediate train I, an intermediate train II for producing thick finished dimensions or preliminary cross-sections with the possibility of quick stand exchanges, a finishing train also with the possibility of quick stand exchanges, the arrangement of the finishing train extending parallel to the intermediate train II, a common water cooling stretch for and displaceable between the two parallel finishing lines, and a winding reel arrangement displaceable between the two finishing lines instead of a subsequently arranged equalizing stretch.

13 Claims, 1 Drawing Sheet

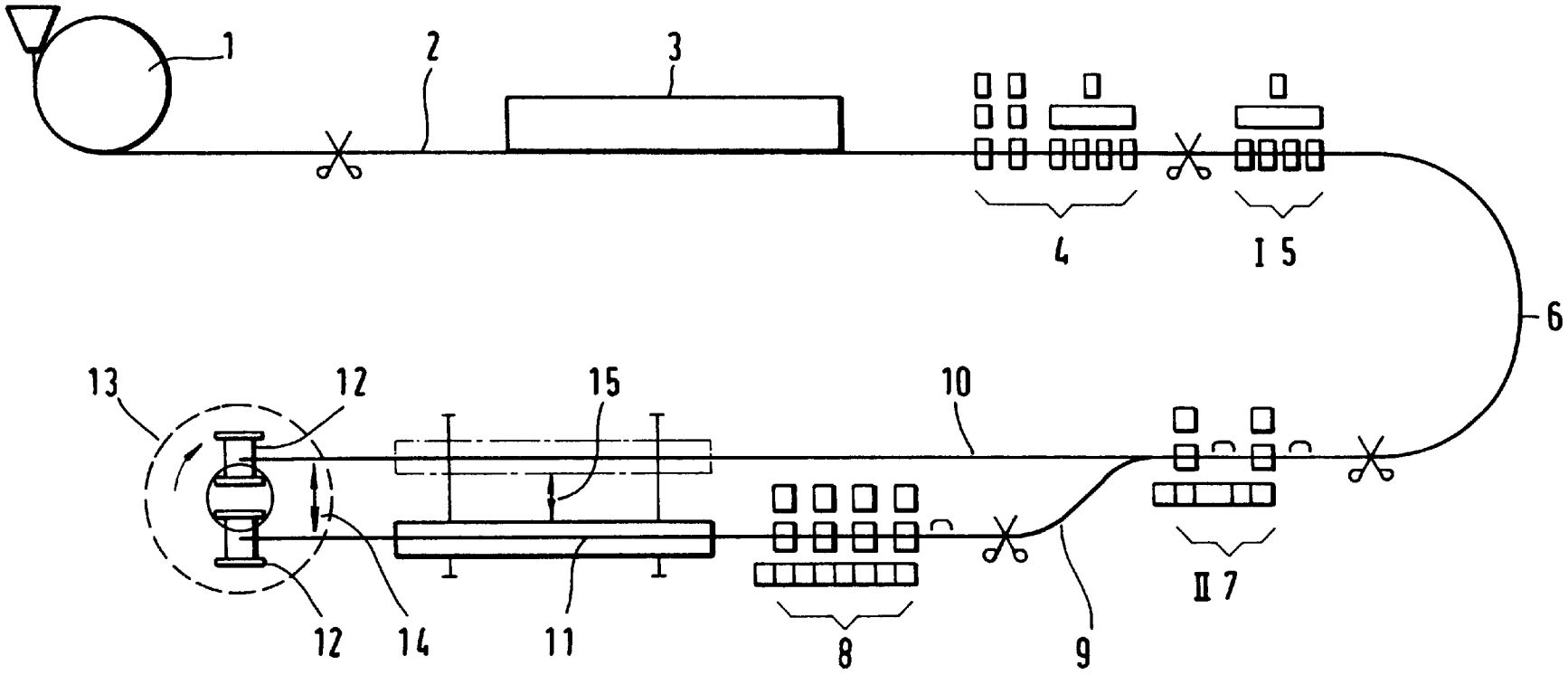
1
2
3
4
5
6
7
8
9
10
11
12
12
13
14
15

HIGH-CAPACITY WIRE ROLLING MILL

BACKGROUND OF THE INVENTION

1. Field of the Invention

The present invention relates to a high-capacity wire rolling mill including a wire train and/or rod steel train for concrete reinforcing steel and simple carbon steels, further including

- a continuous casting plant or a continuous casting wheel for high production,
- a direct interconnection of the continuous casting plant or casting wheel to the rolling mill,
- a buffer furnace between the continuous casting plant or the casting wheel and the rolling mill for compensating production differences and smaller rolling mill interruptions,
- a compact roughing train and intermediate train I, and
- a unit calibration for the train sections.

2. Description of the Related Art

High-capacity wire rolling mills having the above-mentioned features are known in the art. They constitute individual components of a plant concept, however, they are not sufficient for realizing a convincing new concept with respect to the layout for minimized space requirements and investment costs.

In the special print from Klepzik Fachberichte 82 (1974) 11, pages 427/430 with the title "Einadrige Morgan-Siemag-Drahtstraße", [single-strand Morgan-Siemag wore train], author Heinz Bachmann, schedule basics are described for a new wire train in the Werk Diemlach, Austria, in which, due to very narrow space conditions, a space-saving solution had to be found. Taking into consideration the prevailing local conditions and looking for a plant with the lowest possible investment costs, the only remaining solution was a compact single-strand wire train in a U-shaped configuration. An elongated Morgan train for two-shift operation was used for the heat treatment of the wire. The object was to achieve with a specific heat treatment a wire emerging from a wire train which after cooling had good drawing properties and as uniform as possible a pattern of strength over the entire wire length and over the cross-section of the wire.

A detailed discussion of the problems and the state of the art of water cooling following wire trains can be found in the special print from "DRAHT" 29 (1978) 6, pages 286/89. In that case, as a first stage of a controlled cooling from the rolling heat, usually water cooling is used immediately following the finishing block. Several cooling zones are frequently provided for the wire, wherein the cooling zones cool the wire in stages to the desired placement temperature. Provided between the individual cooling zones are recuperation stretches which have the purpose of making it possible for the wire to equalize its temperature over the cross-section thereof. In conventional cooling stretches which operate with water pressures of between 5 and 15 bars, heat transmission coefficients of up to 50,000 $W/m^2$ °C. can occur in the region of the nozzle when the rolling speed is about 60 m/sec. Average heat transmission coefficients are about 30,000 to 40,000 $W/m^2$ °C. When the wire emerges from the cooling stretch, the wire surface is substantially undercooled, while the core of the wire has a remained substantially hotter depending on the cooling intensity and cooling duration. This reference also takes into consideration that significant forces act on the tip of the wire when the wire enters a water-filled pipe, wherein these forces may cause the wire tip to break.

Additional information concerning the heat treatment of steel wire having carbon contents above 0.4% from rolling heat can be found in DE-AS 1 583 411. The invention described in this reference concerns a method of heat treating steel wire from rolling heat, wherein the steel after emerging from the last stand is intermittently superficially quenched and is once again reheated by a temperature equalization with the core cross-section until the pearlite transformation range with an average temperature of 600–665° C. is reached, and the object of this invention is to significantly reduce the previously used substantial length of the cooling stretches at increased rolling speed. In accordance with this reference, this is achieved by cooling the wire surface during quenching intermittently to 70° C. above the martensite transformation temperature, but at least to 400° C., and to subject the wire to intermittent cooling for a period of 0.6 to 0.7 seconds. Quenching takes place in the conventional manner by water cooling and temperature equalization by air cooling.

The special print by "Stahl und Eisen" 108 (1988), Eisenhüttentag, pages 75 to 80 under the title "Temperaturkontrolliertes Walzen von Stabstahl und Draht" [temperature-controlled rolling of rod steel and wire], points out to those skilled in the art that the finish-rolling temperature can be achieved more easily and a better temperature equalization is possible if only one cooling stretch with a long temperature equalization stretch is used. A lowering of the temperature in the finishing train with several cooling stretches, for example, a cooling stretch behind each stand, does not produce the desired result, but increases the length of the plant and is difficult to adjust during practical operation. The reference further mentions that the selected plant arrangement requires that, contrary to the previously used rolling practices, all finished dimensions must be rolled in the two last stands and the stands upstream of the two last stands are not be used when rolling thicker cross-sections. The cooling stretch following the finishing stand has the purpose of reducing the recrystallization in the austenite range, wherein a temperature of about 650° C. is desirable. As a result, the fine granular structure achieved by the transformation is maintained.

Another reference concerning the conception of wire trains with integrated continuous casting plants can be found by those skilled in the art in a translation of the publication from MPT (Verlag Stahl Eisen, Düsseldorf, Germany) Vol. 15 (1992) No. 3, pages 52/58 with the title "Anbindung der Stranggießanlage an Feinstahl- oder Drahtwalzwerke" [interconnection of the continuous casting plant to fine steel or wire rolling mills]by the author U. Svejkovsky. This reference particularly points out the difficulties of a harmonization between the continuous casting plant and the fine steel or wire rolling mill which is due to the fact that these rolling mills have a widely ranging production program with many different dimensions and qualities and small lot sizes. In addition, the various dimensions are rolled in very different quantities because the production quantity is determined very strongly by the rolling speed, especially in the case of small dimensions. This means that the relatively constant continuous casting production cannot be completely sold when rolling small dimensions, while the capacity of the rolling mill is greater in the case of larger finished dimensions.

Described as the best possible solution for these problems has been, inter alia, a heat utilization in accordance with the EHC method (indirect hot charging). In this method, the billets arriving from the continuous casting plant are not directly supplied to the rolling mill furnace, but the thermal energy of the billets is used for heating billets arriving from storage, wherein a heat exchange is carried out in a heating unit. The heating unit is a two-level heat storage unit. In this heat storage unit, cold billet charges which are arriving from storage and are put together in accordance with the rolling schedule are conveyed above the billet charge travelling in the opposite direction and arriving from the continuous casting plant. This causes a heat transfer, preferably by heat radiation.

SUMMARY OF THE INVENTION

Therefore, starting from the prior art discussed above, it is the primary object of the present invention to combine known individual components of plant concepts described above with novel plant elements in such a way that substantial lengths of the cooling stretch which were previously used in the case of increased rolling speeds can be substantially decreased, so that a cooperation of the elements makes it possible to realize the concept of a particularly space-saving construction of the plant.

In accordance with the present invention, in a high-capacity wire rolling mill of the above-described type, this object is met by looping by 180° behind the intermediate train I, an intermediate train II for producing thick finished dimensions or preliminary cross-sections with the possibility of quick stand exchanges, a finishing train also with the possibility of quick stand exchanges, the arrangement of the finishing train extending parallel to the intermediate train II, a common water cooling stretch for and displaceable between the two parallel finishing lines, and a winding reel arrangement displaceable between the two finishing lines instead of a subsequently arranged equalizing stretch.

The arrangement of a single and relatively large-scale water cooling stretch provides the significant advantage that a very intensive cooling of the wire following the finishing train is achieved and, thus, the length of the plant is substantially reduced as compared, for example, to plants with intermittent cooling.

Since a common water cooling stretch is provided which is displaceable between the two parallel finishing lines, the investment costs are significantly reduced and a very economical construction of the plant is made possible.

Since a winding reel arrangement displaceable between the finishing lines is provided instead of a subsequently arranged equalization stretch, a longer air cooling stretch becomes unnecessary and, thus, the length of the plant is shortened in a special manner and the space requirement is reduced. Depending on the entry temperature of the wire from the cooling stretch into the winding coil arrangement, it is now possible for the wire, which may have, for example, an assumed basic weight of 5 t, to form a predeterminable structure quality at a predetermined temperature decrease of the coil per unit of time. This is made possible by the utilization of the cooling technology by means of cooling to transformation temperature in reinforcing steel and simple carbon steel, wherein the wire has already stopped the structure transformation prior to winding and, thus, a temperature guidance, as it is necessary, for example, on the Stelmor conveyor, is no longer required. A significant reduction of costs is achieved by replacing the Stelmor conveyor by the winding station;

replacing the cooling bed by the winding station, or replacing the Garret plant by the winding station.

This technological concept in connection with the direct use of a continuous casting plant or continuous casting wheel for high production make possible an extremely compact total plant while increasing the coil weights from, for example, 2 t to 5 t.

In accordance with a further development of the present invention, the winding reel arrangement is constructed for wire having a diameter of 6–16 mm and for round steel having a diameter of 18–40 mm.

In accordance with an advantageous feature, the winding coils may be arranged in a coiling station and they may include within the coiling station means for displacing the winding reels between the finishing lines.

In accordance with another advantageous development, the water cooling stretch includes means for moving the water cooling stretch between the finishing lines. It is advantageous if the means for displacing the winding reels and the means for displacing the water cooling stretch are synchronously coupled to each other.

The total concept according to the present invention makes possible a layout of the plant which can be accommodated in an area of about 30×150 m.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is schematic illustration of a plant according to the present invention.

DESCRIPTION OF THE PREFERRED EMBODIMENTS

The schematic flow sheet of the plant according to the present invention as shown in FIG. 1, for example, about 600,000 JATO concrete reinforcing steel or simple carbon steels 2 shows a continuous casting plant or continuous casting wheel 1 for high production. In the preferred manner for interconnecting the continuous casting plant 1 to the rolling mill, a buffer furnace 3 is provided for compensating production differences between the continuous casting plant 1 and the rolling mill and for compensating shorter rolling mill interruptions. The buffer furnace 3 is followed initially by a compact roughing train 4 and an intermediate train I 5, wherein the trains are constructed in such a way that a roll exchange is only required during the weekly repair shift, wherein the stands are equipped, for example, with two-groove rolls with alternating use of the grooves. Because of the short length of the roll bodies, the stands have high stiffnesses.

The intermediate train I 5 is followed in the illustrated flow chart by a looping 6 by 180°, and then by an intermediate train II 7 for producing thick finished dimensions or preliminary cross-sections, for example, with diameters of 18–40 mm, for the finishing train. The intermediate train II 7 is configured for quick stand exchanges. A parallel finishing line 9 branches from the finishing line 10 after the intermediate train II 7. The finishing train 8, for example, for rolling stock diameters of 6–16 mm, is arranged in the finishing line 9. Provided in the following run-out stretch is the water cooling stretch 11 which is equipped with means 15 for displacing the water cooling stretch 11 between the finishing lines 9 and 10. A displaceable winding reel arrangement 12 is arranged following the finishing lines 9 and 10, wherein the winding reel arrangement 12 is also equipped with means 14 within the coiling station 13 for displacement between the finishing lines 9 and 10.

As is clear from the flow sheet in FIG. 1, the present invention makes possible a layout for a compact plant having a maximum space requirement of 30×150 m and relatively low investment costs; this can be achieved particularly because of the fact that the usually used Stelmor cooling stretch is replaced by a relatively short water cooling stretch. In order to increase the coil weights, it is proposed to use the coiling station 13 instead of the Garret plant. The plant according to the present invention which utilizes all aforementioned individual components cannot be found in the state of the art which covers a wide area. Accordingly, the invention meets the above-described object in an optimum manner.

While specific embodiments of the invention have been shown and described in detail to illustrate the inventive principles, it will be understood that the invention may be embodied otherwise without departing from such principles.

We claim:

1. A high-capacity wire rolling mill comprising at least one of a wire train and a rod steel train for concrete reinforcing steel and simple carbon steels, further comprising a continuous casting plant, a direct interconnection of the continuous casting plant with the rolling mill, buffer furnace between the continuous casting plant with the rolling mill for compensating production differences and shorter rolling mill interruptions, compact roughing train and an intermediate train I with a unit calibration for the roughing train and the intermediate train I, looping of about 180° following the intermediate train I, an intermediate train II for producing thicker finished dimensions or preliminary sections, with a first finishing line downstream of the intermediate train II, finishing train arranged in a second finishing line extending parallel to the first finishing line, common water cooling stretch for and moveable between the first and second finishing lines, and winding reel arrangement moveable between the first and second finishing lines.

2. The wire rolling mill according to claim 1, wherein the continuous casting plant comprises a continuous casting wheel.

3. The wire rolling mill according to claim 1, wherein the intermediate train II comprises roll stands configured for quick stand exchange.

4. The wire rolling mill according to claim 1, wherein the finishing train comprises roll stands configured for quick stand exchange.

5. The wire rolling mill according to claim 1, wherein the winding reel arrangement is configured for handling wire of 6 to 16 mm and round steel of 18 to 40 mm.

6. The wire rolling mill according to claim 1, wherein the winding reel arrangement is mounted in a coiling station.

7. The wire rolling mill according to claim 6, wherein the winding reel arrangement within the coiling station comprises means for moving the winding reels between the finishing lines.

8. The wire rolling mill according to claim 7, wherein the water cooling stretch comprises means for moving the water cooling stretch between the finishing lines.

9. The wire rolling mill according to claim 8, wherein the means for moving the winding reels and the means for moving the water cooling stretch are synchronously coupled to each other.

10. The wire rolling mill according to claim 1, wherein the wire rolling mill is configured to be accommodated within an area of about 30×150 m.

11. The wire rolling mill according to claim 1, wherein the roughing train and the intermediate train I are configured to require a roll change only during a weekly repair shift.

12. The wire rolling mill according to claim 1, wherein the roll stands of the rolling trains are equipped with two-groove rolls for alternating use of the grooves.

13. The wire rolling mill according to claim 1, wherein the roll stands of the compact roughing train and the intermediate train I are equipped with two-groove rolls for alternating use of the grooves.

* * * * *